US006550713B1

(12) United States Patent
Ruha et al.

(10) Patent No.: US 6,550,713 B1
(45) Date of Patent: Apr. 22, 2003

(54) DEVICE IN CONNECTION WITH REEL-UP OF A WEB

(75) Inventors: Pekka Ruha, Helsinki (FI); Jarkko Räty, Järvenpää (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 09/806,075

(22) PCT Filed: Sep. 22, 1999

(86) PCT No.: PCT/FI99/00777

§ 371 (c)(1),
(2), (4) Date: Mar. 22, 2001

(87) PCT Pub. No.: WO00/17081

PCT Pub. Date: Mar. 30, 2000

(30) Foreign Application Priority Data

Sep. 22, 1998 (FI) ..... 982035

(51) Int. Cl.[7] ..... B65H 18/14; B65H 18/26

(52) U.S. Cl. ..... 242/541.7; 242/534; 242/534.2; 242/541.4; 242/541.5; 242/541.6

(58) Field of Search ..... 242/541.7, 534, 242/534.2, 541.4, 541.5, 541.6

(56) References Cited

U.S. PATENT DOCUMENTS

| | | | | |
|---|---|---|---|---|
| 3,834,642 A | | 9/1974 | Kampf | 242/75.5 |
| 4,634,068 A | | 1/1987 | Malkki et al. | 242/65 |
| 5,308,008 A | | 5/1994 | Rüegg | 242/65 |
| 5,393,008 A | | 2/1995 | Kyytsönen et al. | 242/542.1 |
| 5,853,139 A | | 12/1998 | Hehner et al. | 242/530.1 |
| 5,988,557 A | | 11/1999 | Möller et al. | 242/532 |
| 6,036,137 A | * | 3/2000 | Myren | 242/541.7 |

FOREIGN PATENT DOCUMENTS

| | | |
|---|---|---|
| DE | 3627463 | 2/1988 |
| DE | 4103799 | 8/1992 |
| DE | 4201327 | 7/1993 |
| EP | 0502434 | 9/1992 |

* cited by examiner

*Primary Examiner*—Donald P. Walsh
*Assistant Examiner*—Jonathan R Miller
(74) *Attorney, Agent, or Firm*—Steinberg & Raskin, P.C.

(57) ABSTRACT

A device for use in a reel-up of a paper web, the reel-up including a reeling cylinder mounted on bearings to guide a web on to a reeling axle. The device includes an actuator and a control member for setting and controlling the distance between the reeling cylinder and the reeling axle. The device further includes an actuator and a control member for effectuating and maintaining a force effect between the reeling cylinder and the reeling axle.

15 Claims, 5 Drawing Sheets

DEVICE IN CONNECTION WITH REEL-UP OF A WEB

FIELD OF THE INVENTION

The present invention relates to a device in connection with a reel-up of a web. The invention also relates to a method in connection with a reel-up of a web.

BACKGROUND OF THE INVENTION

Reel-ups of web-like materials are used for reeling a material passed in a continuous web into a tight reel, so that it can be transferred to further processing. In the reel-ups of a paper web, a continuous paper web passed from a paper machine, a coating machine or corresponding paper processing apparatus is reeled around a reeling axle i.e. a reel, spool, to form a reel. For example in a so-called Pope-reeler, or in a center-drive assisted Pope-reeler, the finished paper is reeled around a reeling axle. The web is passed on the reel via a reeling cylinder rotatably arranged, against which the reeling axle is loaded by means of a loading device located in connection with the reeling axle.

The web is passed to the reeling axle via a nip formed between the preceding layers of the reel and the mantle surface of the reeling cylinder. At this point where the web enters in contact with the preceding layers of the reel, the web is, due to the aforementioned loading device, affected by a particular nip load, linear pressure. In present-day reel-up types, the reeling nip between the reeling cylinder and the reel primarily prevents the access of air into the reel. By controlling the loading exerted on the web it is, however, also possible to control the tightness of the reel that is being formed, and in addition to this, the aim is to change the loading during the reeling, so that the tightness of the reel would comply with the quality requirements set by the paper grade and the finishing process in different sections in the radius of the reel. The reeling process is controlled indirectly by adjusting the reeling parameters (e.g. linear load, web tension, peripheral force and reeling force). The adjustment is typically conducted with a special program. The main objective of the reeling is to reel a continuous paper web to form a reel which fulfills the requirements imposed thereupon by the reeling process and further processing with respect to processibility and thereby the structure of the reel as well as the paper quality.

When the old reel has become full, the web has to be cut and the winding of the web following the cut-off point around a new reeling axle has to be started. In practice, this takes place in such a way that when the paper roll formed around the reeling axle has accumulated into its full size, a new empty reel is transferred, typically simultaneously and from above the reeling cylinder, onto the surface of the reeling cylinder, while the paper web is left therebetween. The full paper reel is transferred away from the reeling cylinder, and thereafter the paper web is cut with a suitable way and the end of the web following the cut-off point is guide d onto the perimeter of an empty reeling axle, onto which the new web begins to accumulate to form a reel. Thereafter the new reeling axle is transferred to a reeling carriage, travelling on separate linear guides, or on top of horizontal reeling rails. The reel that has become full is transferred e.g. by means of a transfer device along the reeling rails to an unloading station, and at the same time a new reeling axle is brought onto the reeling rails. During the initial reeling process the loading is controlled by means of force devices of the initial reeling device, and when the reeling axle has been transferred e.g. to the reeling carriage, the loading is controlled by means of force devices coupled to the reeling carriage, typically by means of pressurized medium operated actuators, i.e. cylinders.

For example U.S. Pat. No. 4,634,068 discloses a reeling apparatus equipped with force devices of the initial reeling device, i.e. with a separate loading cylinder and a relief cylinder, and when the reeling axle is on the reeling rails, with a loading cylinder which presses the axle against the reeling cylinder. The used loading cylinder is coupled e.g. to swinging arms turnably articulated in the frame of the reel-up. By means of the relief cylinders it is possible to compensate for the effects of gravity on the reeling cylinder, and thus these are used for so-called profiling. Typically in the initial reeling device the loading, relieving and the adjustment of the position of the reeling axle with respect to the reeling cylinder are conducted by means of one double-acting pressurized medium operated cylinder. In the reel-up the loading force is determined by measuring the angular position of the swinging arms. The loading force is adjusted by means of an actuator coupled to the swinging arm.

In a control circuit of a reel up, which is disclosed in the U.S. Pat. No. 5,285,979, the loading takes place by means of a carriage moving in the frame of the reel-up along linear guides, to which carriage the loading force device is connected. In the publication the reeling axle is arranged in a swinging arm turnably journalled to the carriage, which swinging arm, however, remains stationary during the loading and is only used when the full reel is removed by turning the swinging arms to the direction of removal with special removal cylinders. The aforementioned force device is used to supply the desired loading force or to transfer the reeling axle further away from the reeling cylinder as the size of the reel grows. The actual loading force is affected by many factors such as the friction produced by the motion of the force device as well as the kinetic friction of the structure supporting the reeling axle when it is moved. The loading force is measured in the device with sensor means arranged in connection with the swinging arm.

There are also known reel-ups such as the one presented in EP patent 604558 and in the related U.S. Pat. No. 5,393,008. The patent discloses carriages arranged which are linearly movable in guides parallel to the reeling rails, the position of the carriages being determined on the basis of hydraulic cylinders coupled between the frame of the reel-up and the carriages. Thus, by means of these hydraulic cylinders, the location of the reeling axle is at the same time also adjusted with respect to the reeling cylinder. The carriages are provided with separate pressing devices which press the bearing housings located at the ends of the reeling axle and resting on the reeling rails with an adjustable force towards the reeling cylinder to produce the necessary nip pressure. On the other side of the bearing housing, the carriages are also provided with positioning devices by means of which the location of the reeling axle in the carriage can be adjusted more accurately. The loading force is measured in the device with sensor means arranged in connection with the pressing device.

The publication EP 0 79 829 A2 discloses a reeling device in which the reeling cylinder is arranged in a moving carriage which is also provided with a pressurized medium operated cylinder to function as a force device to effect a loading between the reeling cylinder and the reel. The carriage can be moved by means of separate actuators.

In the above-described cases, to control e.g. the reeling carriage, the initial reeling device and the loading device, hydraulic cylinders are typically used in pairs to control the different ends of the reeling axle. Thus, the control of the ends is arranged for example by means of an integrated carriage or a carriage arranged in connection with each end to move independently.

In the above-described device the act of measuring the loading force of the nip is, however, arranged in a manner which is affected disturbingly by frictions due to the function of the device, such as rolling frictions, sliding frictions and other mechanical disturbances occurring in the members used for measurement.

In addition, in the above-described devices, separate apparatuses are used for adjusting both the loading force by controlling the pressure of the force devices and e.g. the position of said carriages by controlling the actuators. This results in a complicated control process and requires a considerable accuracy and reliability especially from the pressure adjustment.

OBJECTS AND SUMMARY OF THE INVENTION

It is an aim of the present invention to eliminate the drawbacks of prior art and to present a simple and reliable device to be used in connection with a reel-up, for example to control the loading, i.e. so-called nip load, between a reeling cylinder and a reeling axle which is placed in the transfer carriage of the reel-up and controlled by means of separate carriages from its ends and located in the initial reeling device or placed on reeling rails, or to control the distance between the same or the mutual position of the same by means of pressurized medium operated cylinders. It is a central principle of the invention to apply an elastic element that stores energy.

It is a considerable advantage of the device according to the present invention that it is possible to implement the adjustment of the loading force in a very simple manner by means of position adjustment, conducted with actuators functioning as force devices, wherein it is possible to avoid pressure adjustment. This makes the construction of the sensor means required in the reel-up considerably more simple, and facilitates the adjustment to be conducted. Advantageously, the loading and the positioning is taken care of by a pair of pressurized medium operated cylinders. Another advantage of the invention is that by directly measuring the dimension changing according to the loading force of the element, especially the disturbing effects of the friction forces affecting the measurement are avoided. Furthermore, it is an advantage of a preferred embodiment of the invention that the element is independent of an external power source, wherein it utilizes only the energy stored therein. The energy is stored in the element in a very simple manner for example by compressing it in connection with the position adjustment.

BRIEF DESCRIPTION OF THE DRAWINGS

In the following, the invention will be described in more detail with reference to the appended drawings in which.

DETAILED DESCRIPTION OF THE PREFERRED EMBODIMENTS

Figure 1:
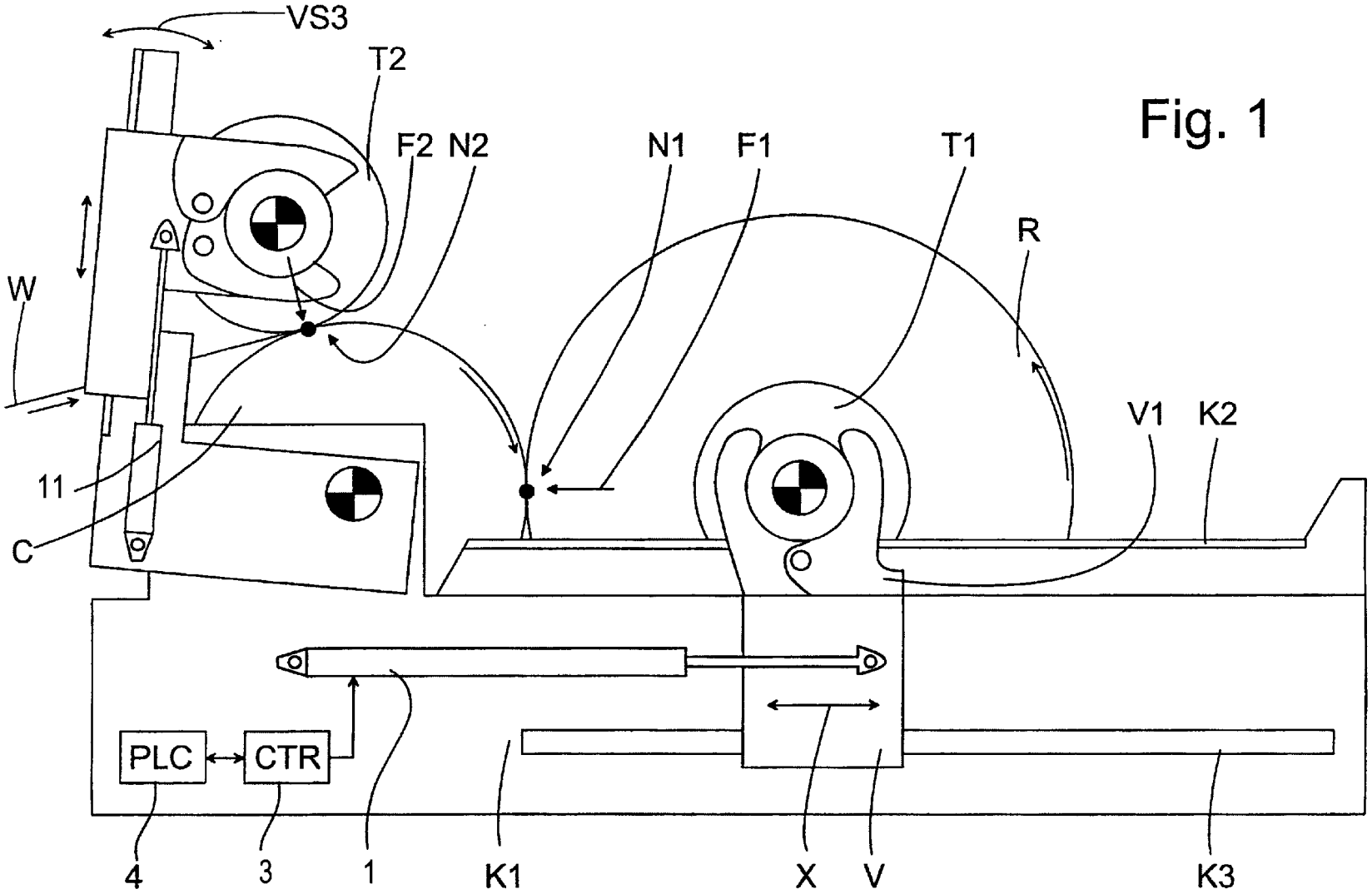
FIG. 1 is a side elevational view of a prior art reel-up of a web.

FIG. 1 is a reduced skeleton diagram showing a side view a reel-up of a paper web, known as such. As is well known, the reel-up is provided with a reeling member, typically a rotatable reeling cylinder C, by means of which a continuous paper web W passed from a paper machine, a coating machine or another paper processing apparatus is reeled around a reeling axle T1 to form a machine reel R. There are also other known reeling members, such as a belting, for guiding the web W onto the reeling axle T1. The reel R is loaded against the reeling cylinder C by applying a force F1 of desired strength, directed towards the reeling cylinder C, to the reeling axle T1. This produces a reeling nip N1 between the reel R and the reeling cylinder C, where a nip pressure of particular strength prevails as a result of the loading. The reeling axle T1 is advantageously also provided with a centre-drive, wherein the reel-up in question is a centre-drive assisted Pope reel-up, in.which the torque of the reeling axle T1 can also be used to affect the quality of the reel R being formed. FIG. 1 also shows a reeling axle T2 brought in connection with the reeling cylinder C by means of an initial reeling device of the reel-up. The reeling axle T2 is loaded against the reeling cylinder C by applying a force F2 of desired strength directed towards the reeling cylinder C, to the reeling axle T2. This produces a reeling nip N2 between the reeling axle T2 and the reeling cylinder C, where a nip pressure of particular strength prevails as a result of the loading. In this case, the nip pressure is also affected by the weight of the reeling axle T2.

The reeling cylinder C is pivoted in a way known as such to a frame K1 of the reel-up, stationary with respect to a supporting base, such as the floor level of a factory. The reeling axle T1, in turn, is pivoted in a way known as such on top of reeling rails K2 on the support of which the ends of the reeling axle T1 rest at the bearing housings, and which at the same time support the weight of the reel R. The supports V1 of a carriage or a slide V, pivoted in a way known as such and moving in a linear guide K3 located in the frame K1, are utilized to maintain the force exerted on the reeling axle T1, and at the same time the carriage is moved in the longitudinal direction (arrow X) of the reel-up when the size of the reel R is increased during the reeling process. A known structure is presented in more detail e.g. in the European patent 604558. The carriage V also moves in the longitudinal direction of the reel-up and it is of such a type that excluding a weight possibly received by the reeling cylinder C, the reeling rail K2 supports the entire weight of the reeling axle T1 and the reel R. The carriage V is arranged.in a way known as such to move in linearly with respect to the reeling cylinder C, and the motion is possible in both directions; in other words, if necessary, the carriage V can be moved back and forth (arrow X) by means of double-action cylinders when necessary. The carriage V can move on top of fixed linear guides or it can be guided by rails. The support V1 or its parts, articulated in the carriage V to turn with respect to a pivot located therein, can also be transferred by means of separate hydraulic cylinders (not shown in the drawing), e.g. to move the completed reel away from the carriage V.

With reference to FIG. 1, to attain the desired nip load (nip pressure), the reel R is loaded against the reeling cylinder C with a predetermined loading force F1 by affecting the reeling axle T1 by means of force devices 1, hereinafter also called as an actuator 1. These actuators are included in the first control means of the reel-up which are arranged for setting and maintaining the distance between the reeling cylinder C and the reeling axle T1, which are placed substantially in parallel. The first control means also comprise the necessary control members 3 (in the drawing also CTR), for example an actuator 1 and electrically controlled valves for controlling the actuator 1 by means of a pressurized medium in a way known as such. The first control means are connected to a control system 4, which is for example a computer or a programmable logic (PLC, not shown in the drawing) equipped with memory means and a microprocessor. In the control system 4, e.g. the necessary monitor and control algorithm is stored e.g. to control the control members 3 in such a way that the actuator 1 is transferred to a desired position or the actuator 1 is maintained in the desired position, wherein position adjustment is conducted.

The reel-up also comprises second control means to effect and maintain a first force effect between the reeling cylinder C and the reeling axle T1 arranged substantially in parallel and in contact with each.other. The second control means comprise control members 3 (in the drawing also CTR), for example an actuator 1 and electrically controlled-valves for controlling the actuator 1 by means of a pressurized medium in a way known as such. In the reel-up of prior art according to FIG. 1, the first and second control means comprise a common actuator 1 and at least partially common control members 3. In the control system 4, at least the necessary monitor and control algorithm is stored e.g. to control the control members 3 in such a way that the pressure of the actuator 1 is adjusted to a suitable value, or the pressure of the actuator 1 is maintained on a suitable level in order to maintain the force effect F1 on the desired level, wherein pressure adjustment is conducted. On the basis of the above-described devices of prior art, it is obvious that the first and the second control means can also be separate devices. According to the present invention, the second control means can be considerably simplified.

Further referring to FIG. 1, a loading force F2 is effected in a similar manner by means of force devices 11. The force devices 1, typically one on each side of the reel R in a similar manner as force devices 11, affect the bearing housings of the reeling axle T1 which are typically supported by the reeling rails K2. The reeling axle T1 is transferred further away from the reeling cylinder, C when the reel R grows, i.e. the radius of the reel R is increased, wherein the carriages V are transferred by means of force devices 1. When the reeling proceeds, the desired nip load is attained by means of the force devices 1.

The force F1 effected by the loading actuators 1 can be adjusted. The most typical force device which is used in the reel-ups, whose force can be adjusted and by means of which large loading forces can be attained, is a pressurized medium operated force device, such as a hydraulic cylinder which is of such a type that it changes its length. The hydraulic cylinder is connected to a pressure source of a hydraulic fluid, and the hydraulic pressure which is effective in the hydraulic cylinder and determines the loading force F1, can be adjusted in ways known as such. Thus the adjustment in question is a so-called pressure adjustment, and on the other hand, when e.g. the reel R is transferred by means of the hydraulic cylinder, or when its position is changed by controlling the volume flow of the hydraulic cylinder, the term position adjustment is used. During the position adjustment, pressure is required to overcome the frictions during the transfer and to produce a flow in the pipework of the hydraulic fluid by means of a pressure difference. The term position adjustment is also used in a situation when a desired distance i.e. a nip gap is desired to be maintained for example during the reeling process.

Figure 2A:
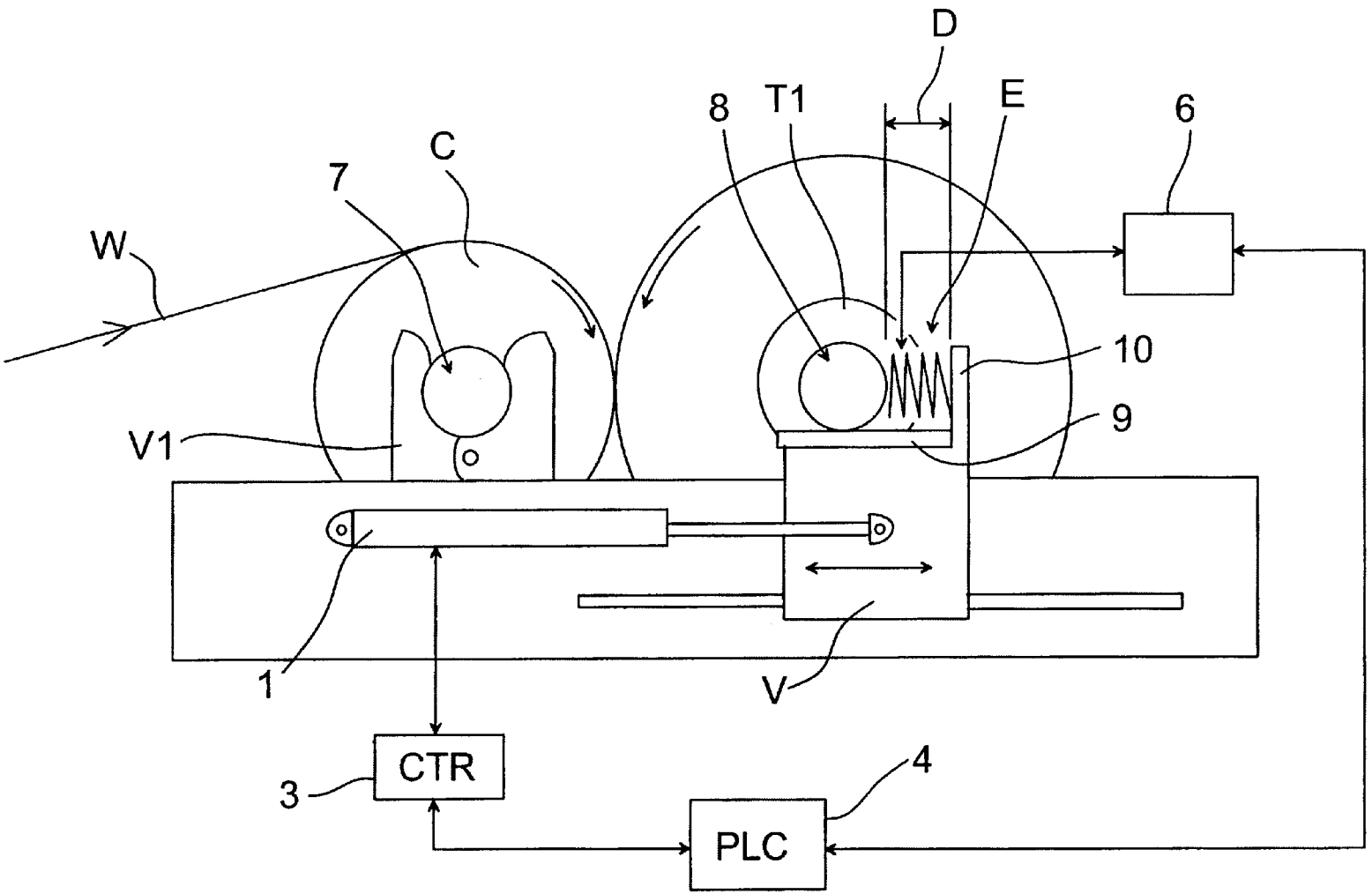
FIGS. 2*a* to 2*d* are reduced side elevational views of the devices according to the preferred embodiments of the invention.

With reference to FIGS. 2*a* to 2*d*, the use of the element E according to the invention will be described in more detail hereinbelow. The second control means comprise this elastic element E that stores energy, to produce and maintain the first force effect F1. A change in a dimension of the element E is proportional to the change in the first force effect F1, and the element E is arranged to store energy by compressing under the effect of the force affecting the same, and to, release energy by expanding. For the sake of clarity, in FIGS. 2*a* to 2*d*, the element E is shown as a simple cylindrical round wire pressure spring E, but it is obvious that the element E can be some other component which functions in the above-described manner. The variable dimension of the element E is its height, width or length, depending on the manner in which the function of the element E is arranged, and in which way it is possible to arrange the measurement. FIG. 2*a* also shows a variable dimension D, wherein the end of the element E rests on a stationary support 10, and the other end affects the bearing arrangement 8, the position of which end is thus changed, and this change can be measured with the sensor means 6. Thus, the support 10 can function as a reference position.

According to the invention, the operating principle of the element E is that a change in any dimension is proportional to thin force effective thereon, and thus also to the magnitude of energy stored therein. Energy is stored in the element E as potential energy, which is thus released as a force effective in the element when the change in the dimension is elastically restored. When the element E functions elastically, its form is restored when the effective force is reduced or released, and, correspondingly, changes when the effective force is increased. The proportionality of the force and the dimension can be described with a function $F=f(D, k_n(x_n), k_{n+l}(X_{n+l}), \ldots)$, in which F is the effective force, D is the value of the dimension in question and $k_n$, $k_{n+j}$ etc. are factors dependent (i.e. functions of the variables $x_n$, $x_{n+l}$ etc.) e.g. on the used materials, the construction and the operating principle, for example in the pressure spring one coefficient $k_n$ is the spring constant of the spring. The function F can be determined e.g. by means of measurements. In its simplest form the function is linear and of the form $F=k \cdot D$, but the dependency can also deviate from the linear one e.g. by being progressive. The dependency can also be arranged into a form in which $\Delta F$ is the change in the force, which is dependent e.g. on the change in the dimension $\Delta D$. Between the force effect F1 and the force F, which will be described hereinbelow, there still prevails a dependency F1=f(F), which is dependent e.g. on the construction of the bearing arrangement, and thus the loading force F1 can be adjusted according to the invention by controlling the dimension D. This control takes places e.g. by affecting the slide V with the actuator 1, whereafter the slide V, in turn, presses the pressure spring functioning as the element E against, the bearing arrangement. The actuator 1 is simultaneously controlled by monitoring the dimension D. For example the force F1 can be controlled by keeping the dimension D substantially constant.

Further referring to FIGS. 2*a* to 2*d*, the reel-up also comprises the necessary sensor means 6 for determining the first force effect F1, and these sensor means 6 are connected to the control system 4 to transmit e.g. measurement information. In the device according to the invention, these sensor means 6 are arranged to measure, either directly or indirectly, a dimension of the element E described hereinbelow, wherein the measurement in question is a measurement of length, position or distance, or a measurement with respect to the reference position, depending on the manner in which the measurement is arranged, or on the measuring devices which are desired to be used. In the measurement it is possible to utilize devices known as such, which function mechano-electrically, capacitively, inductively, photoelectrically or for example by means of ultrasound, and transmit the measurement information in an analog or digital signal to the control system 4. In their simplest form the sensor means 6 comprise for example a potentiometer which functions in a linear manner.

Hereinabove, the function of an initial reeling device was also described, wherein one has to take into account the effect of gravity in particular. For example the weight of the reeling axle can increase or reduce the force effect F1, depending on the vertical position of the same with respect to the reeling cylinder. Thus, especially the element E placed in a diagonal position can also be affected by the weight of the reeling axle, which can be easily taken into account in the above-described dependency, wherein when the reel grows, and the weight increases, time also constitutes one factor in the dependency. With reference to FIGS. 2*a* to 2*d*, the element E is arranged effective substantially in the longitudinal direction of the reel-up, i.e. horizontally, wherein the bearing arrangements 7 and 8 of the reeling axle T1 and the reeling cylinder C are arranged substantially on the same horizontal level, wherein the effect of the gravity is minimized. In case of said pressure spring, the compression and expansion are arranged to take place in the direction of the effective force, wherein the changing dimension is the length of the pressure spring. In case of the pressure spring, the size of its diameter does not change when the force affects the spring, and energy is stored in the spring when it is compressed. There are also known cylindrical pressure springs in which the shape of the wire varies and which are typically made of composition metals. There are also known spring constructions to which severals springs are connected to attain for example a phased or a progressive function. In addition, there are known cylindrical draw-springs wherein energy is stored in the spring when its length is increased, according to which the function of the element E also has to be arranged. Furthermore, there are e.g. known multi-disc springs and leaf springs, in which the change occurs in the longitudinal direction, but there are also known spiral springs and torsion springs in which the change occurs as an arch-like shift and typically also as a change in the diameter. A special advantage of e.g. the pressure spring and the draw-spring is the change in the dimension occurring in the direction of the force effective therein, the simple construction and the independency on external energy sources, for example electric energy or the energy of a pressurized medium.

Naturally, the spring-like element E that stores energy can also be a suitable compressible gas or liquid, which is closed within a volume and which is affected for example by means of a moving piston. Thus, it is possible to utilize for example the position of the piston to measure a change in the dimension of the volume. The selection of the element E is also dependent on the extent of the change in the dimension, and on that how accurately the change can be measured. Typically, the change is greater in gaseous substances than in solid substances. The element can also be a pressurized medium operated cylinder, which is possibly connected to a pressure accumulator.

With reference to FIGS. 2*a* to 2*d*, the use of the device according to the invention in connection with a reel-up will be described hereinbelow in more detail by means of preferred embodiments. On the basis of the description it is obvious for anyone skilled in the art how the invention can be implemented in connection with other types of reel-ups within the scope of the claims. According to the description above, the reel-up comprises a reeling cylinder C mounted on bearings 7 in the reel-up to guide a web travelling in the longitudinal direction of the reel-up according to FIG. 1, which reeling cylinder C is arranged to rotate around a direction transverse to the web, and a reeling axle T1 mounted on bearings 8 in the reel-up to reel the web around the reeling axle T1, which reeling axle T1 is arranged to rotate around a direction transverse to the web.

According to the invention, the reel-up comprises at least one guide or the like, and at least one bearing arrangement 7 or 8 is arranged to move by means of a guide or the like in the longitudinal direction of the reel-up, wherein the element E is also arranged to affect said bearing arrangement 7 or 8. The guide (or the like) shown in FIGS. 2*a* to 2*d* is a guide 9 positioned in a slide V arranged to move in the longitudinal direction of the reel-up. The reeling rail K2 shown in FIG. 1, is shown with broken lines in FIGS. 2*b* to 2*c* to illustrate an alternative construction of the reel-up. Especially the reeling axle T1 is advantageously placed on top of the reeling rail K2, along which it is transferred according to FIG. 2*b* . In FIG. 2*c*, the reeling axle T1 is mounted on bearings in a fixed position at least for the duration of most of the reeling process, but the supports V1 can also be arranged in a moving carriage (not shown in FIG. 2*c*), which, in turn, is controlled with an actuator (not shown in FIG. 2*c*) separate from the actuator 1 in a similar manner as in FIG. 2*b* . Said actuator can be connected to the control members 3. A more detailed arrangement by means of which the element E affects the bearing, is obvious to anyone skilled in the art, and it can be implemented in various ways. In FIGS. 2*a* to 2*d* this arrangement is shown in a simple manner by means of a support 10 arranged in the slide V and the element E affecting the bearing arrangement directly, and it is obvious that for example the element E can also affect the bearing arrangement indirectly, wherein the bearing arrangement may be provided with supports corresponding to the supports controlling the bearing arrangement of FIG. 1.

In the embodiment of FIG. 2*a* , the element E is arranged to affect the bearing arrangement 8 of the reeling axle T1, wherein the first control means are arranged to move the reeling axle T1. In FIG. 2*a* , the reeling cylinder is mounted on bearings onto a fixed position, but the supports V1 can also be arranged in a moving carriage (not shown in FIG. 2*a*), which, in turn, is controlled with an actuator (not shown in FIG. 2*a* ) separate from the actuator 1 in a similar manner as in FIG. 2*d*. Said actuator can be connected to the control members 3. In the embodiment of FIG. 2*c*, the element E is arranged to affect the bearing arrangement 7 of the reeling cylinder C, wherein the first control means are arranged to move the reeling cylinder C. In both cases the guide 9 and the element E are arranged in the slide V, which is arranged to be moved by the first control means. The transfer takes place in the above-described manner by means of the actuator 1 and the control members 3.

On the basis of the description above, there are also known reel-ups in which the bearing arrangement is affected by means of a force device coupled to the swinging arms articulated turnable on the frame of the reel-up, which force device corresponds to the actuator 1. Thus, the element E can be arranged in connection with the swinging arm in question. Also in this case, the reeling cylinder C or the reeling axle T1 can be located on top of the reeling rail K2.

Figure 2B:
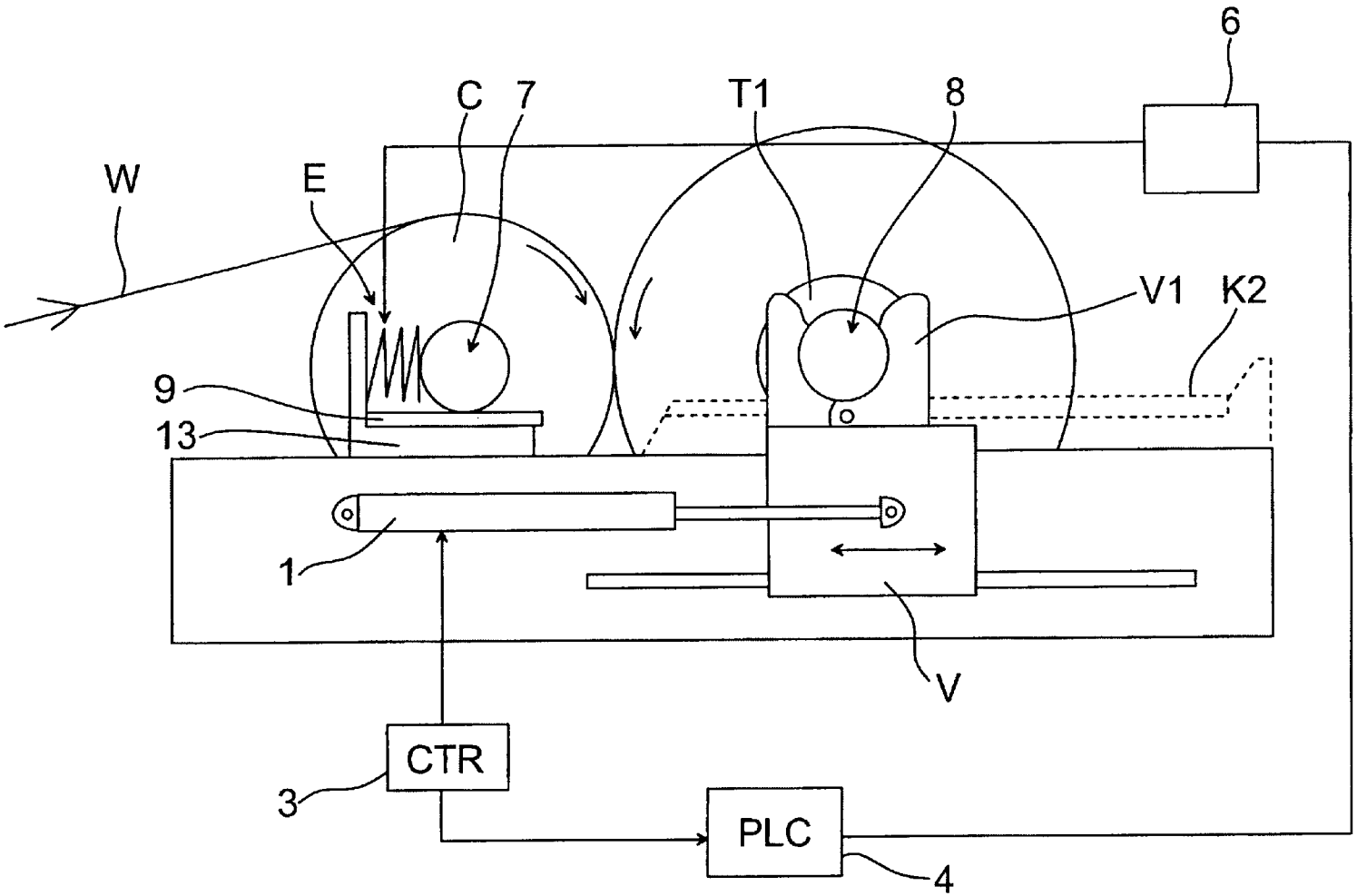
Figure 2C:
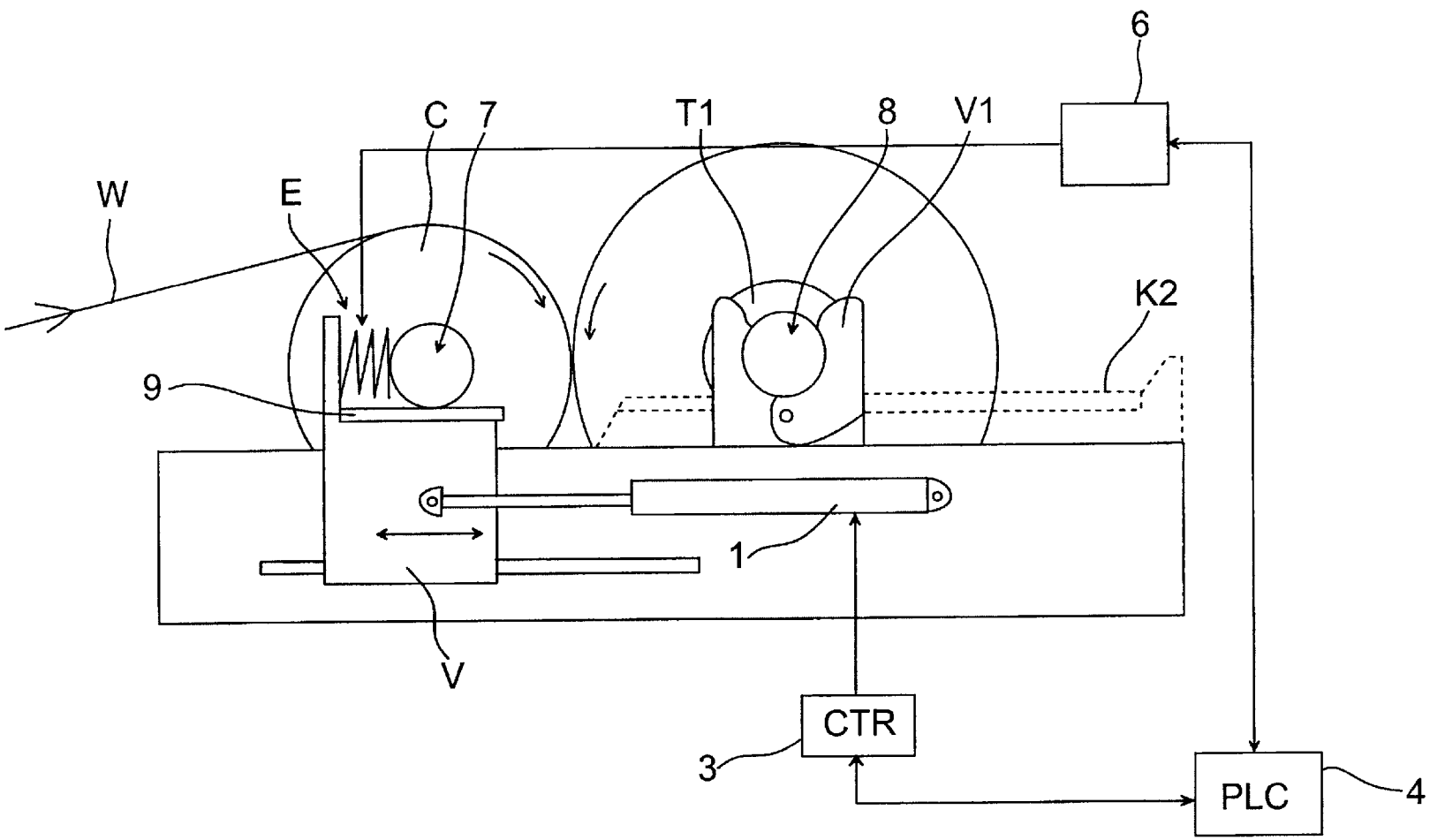
Figure 2D:
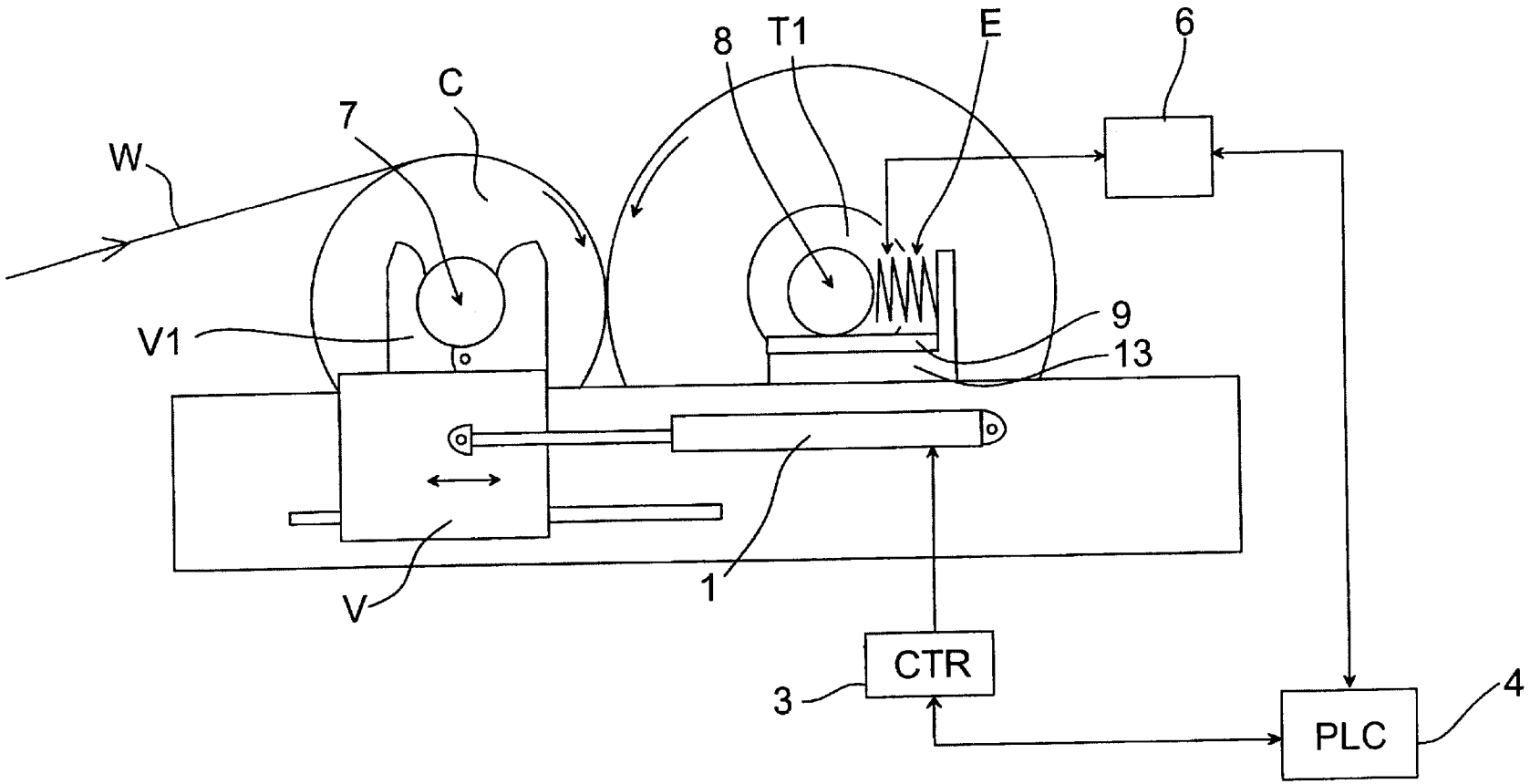

In the embodiment of FIG. 2*b* the element E is arranged to affect the bearing arrangement 7 of the reeling cylinder C, wherein the first control means are arranged for moving the reeling axle T1. In the embodiment of FIG. 2*d*, the element E is arranged to affect the bearing arrangement 8 of the reeling axle T1, wherein the first control means, are arranged to move the reeling cylinder C. In both cases the guide 9 and the element E are arranged in a fixed position 13, and the first control means are arranged to move the slide V. The transfer takes place in the above-described manner by means of the actuator 1 and the control members 3. In the embodiment of FIG. 2*b* the bearing arrangement 8 is arranged in the slide V to transfer the reeling axle T1 and in the embodiment of FIG. 2*d* the bearing arrangement 7 is arranged in the slide V to move the reeling cylinder C.

According to the invention, the force effect F1 can now be adjusted in such a way that the dimension D, which tends to change when the reel grows and the force effect increases, is measured when for example the slide V has been positioned into a desired point. By means of position adjustment the slide V is transferred into such a position, that the dimension D is the desired one. Because the above-described dependency prevails between the dimension D and the force effect F1, it is thus possible to adjust the force effect in a very simple manner. This adjustment is implemented by means of the monitor and control algorithm stored in and implemented by the control system 4, wherein the control system 4 is coupled to the sensor means 6 to attain measurement information and at least to the control members 3 of the first control means to affect the element E. In connection with the measurement the measured information can be processed, filtered or their average value can be calculated, wherein for example the changes in the dimension which result from impacts and unevenness of the reel, would not interfere with the measurement itself. Thus, a further advantage of a preferred embodiment of the element is that it endures impacts and variations in.the loading better than rigid structures of prior art, wherein for example the cushioning of the reel-up can be more easily arranged.

It is obvious for anyone skilled in the art that the invention is not restricted solely to the above-described preferred embodiment, but it can vary within the scope of the claims. It is also obvious for anyone skilled in the art that the above-described element can be applied in connection with various reel-up applications.

What is claimed is:

1. A reel-up for a web comprising:

a reeling means (C) mounted on a first bearing arrangement (7, 8) to guide a web (W) traveling in the reel-up on to a reeling axle (T1), a reeling axle (T1) mounted on a second bearing arrangement (7, 8) in the-reel-up to reel the web (W) around the reeling axle (T1), said reeling axle (T1) arranged to rotate around a direction transverse to the web (W), first control means (1, 3) for setting and controlling a distance between the reeling means (C) and the reeling axle (T1), second control means (1, 5) for effecting and maintaining a force effect (F1) between the reeling means (C) and the reeling axle (T1), the second control means (1, 5) comprising an elastic element(E) that stores energy, to effect and maintain the force effect (F1), in which element (E) a change in a dimension (D) is proportional to a change in the force effect (F1), and sensor means (6) which are arranged to measure said dimension (D).

2. The reel-up according to claim 1, further comprising:

at least one guide (9), and wherein at least one of said first and second bearing arrangements (7, 8) are structured and arranged to move by means of the guide (9) in a longitudinal direction of the reel-up, and that the element (E) is structured and arranged to apply a force said at least one of said first and second bearing arrangements (7, 8).

3. The reel-up according to claim 2, wherein the element (E) is structured and arranged to apply a force to at least the first bearing arrangement (7, 8) of the reeling means (C), wherein the first control means (1, 3) are structured and arranged for moving the reeling axle (T1).

4. The reel-up according to claim 3, wherein the reeling axle (T1) is structured and arranged to be moved by means of a second slide (V) in a longitudinal direction of the reel-up, and wherein the first control means (1, 3) is structured and arranged to move said second slide (V).

5. The reel-up according to claim 3, wherein the reeling means (C) is structured and arranged to be moved by means of a second slide (V) in a longitudinal direction of the reel-up, and wherein the first control means (1, 3) is structured and arranged to move said second slide (V).

6. The reel-up according to claim 2, wherein the element (E) is structured and arranged to apply a force to at least the second bearing arrangement (7, 8) of the reeling axle (T1), wherein the first control means (1, 3) are structured and arranged for moving the reeling means (C).

7. The reel-up according to claim 2, wherein the element (E) is structured and arranged to apply a force to the first bearing arrangement (7, 8) of the reeling means (C), and that the guide (9) and the element (E) are structured and arranged in a first slide (V) arranged to move in a longitudinal direction of the reel-up, said slide being structured and arranged to be moved by the first control means (1, 3).

8. The reel-up according to claim 2, wherein the element (E) is structured and arranged to apply a force to the second bearing arrangement (7, 8) of the reeling axle (T1), and that the guide (9) and the element (E) are structured and arranged in a first slide (V) structured and arranged to move in a longitudinal direction of the reel-up, said slide being structured and arranged to be moved by the first control means (1, 3).

9. The reel-up according to claim 1, wherein the element (E) is structured and arranged to store energy by compressing when affected by an effective force acting thereon and to release energy by expanding when said effective force is removed, and that the compression and expansion is arranged to take place substantially in a direction of the effective force.

10. The reel-up according to claim 1, wherein the element (E) is at least partly formed as one of a pressure spring and a draw-spring.

11. The reel-up according to claim l, wherein the reel-up further comprises:

a control system (4) connected to the sensor means (6) to guide the first and the second control means (1, 3, 5, E).

12. A method for arranging a reel-up of a web comprising the steps:

mounting a reeling means (C) on a first bearing arrangement (7, 8) in the reel-up to guide a web (W) traveling in the reel-up on to a reeling axle (T1), mounting a reeling axle (T1) on a second bearing arrangement (7, 8) in the reel-up to reel the web (W) around the reeling axle (T1), which reeling axle (T1) is arranged to rotate around a direction transverse to the web (W), effecting and maintaining a force effect (F1) between the reeling means (C) and the reeling axle (T1) at least partly by means of an elastic element (E) that stores energy, in which element (E) a change in the dimension (D) is proportional to a change in the force effect (F1), and monitoring said dimension (D) to control the force effect (F1).

13. The method according to claim 12, further comprising the step of:

maintaining the dimension (D) in a predetermined value by controlling the positions of the reeling means (C) and the reeling axle (T1) related to each other.

14. The method according to claim 13, further comprising the step of: controlling the positions of the reeling means (C) and the reeling axle (T1) related to each other by moving the reeling means (C) or the reeling axle (T1).

15. A reel-up for a web comprising:

reeling means (C) mounted on a first set of bearings (7) for guiding a web (W) traveling through said reel-up;

a reeling axle (T1) structured and arranged for receiving said web (W) from said reeling means, said reeling axle (T1) being mounted on a second set of bearings (8) for reeling said web (W) therearound, wherein said reeling axle (T1) is structured and arranged to rotate in a direction transverse to a direction of movement of said web (W) though said reel-up;

first control means (1, 3) structured and arranged for setting and controlling a distance between said reeling means (C) and said reeling axle (T1);

second control means (1, 5) structured and arranged for effecting and maintaining a nip load between said reeling means (C) and said reeling axle (T1); wherein said second control means (1, 5) comprises an elastic element (E) for storing energy, wherein said elastic element (E) is responsive to said nip load, wherein a change in a length (D) of said elastic element (E) is proportional to a change in said nip load; and sensor means (6) adapted to measure variations in said length (D) of said elastic element (E).

* * * * *